US007194831B1

(12) United States Patent
Cullinan

(10) Patent No.: US 7,194,831 B1
(45) Date of Patent: Mar. 27, 2007

(54) MENU SYSTEM

(76) Inventor: James E. Cullinan, 2737 Welsford Rd., Columbus, OH (US) 43221

( * ) Notice: Subject to any disclaimer, the term of this patent is extended or adjusted under 35 U.S.C. 154(b) by 60 days.

(21) Appl. No.: 10/775,000

(22) Filed: Feb. 9, 2004

Related U.S. Application Data

(63) Continuation-in-part of application No. 10/158,698, filed on May 30, 2002, now Pat. No. 6,688,025.

(60) Provisional application No. 60/295,076, filed on May 31, 2001.

(51) Int. Cl.
*G09F 13/04* (2006.01)

(52) U.S. Cl. ..... 40/568; 40/611.08; 40/575; 40/576; 40/600

(58) Field of Classification Search ..... 40/611.08, 40/568, 574, 575, 576, 564, 620, 600
See application file for complete search history.

(56) References Cited

U.S. PATENT DOCUMENTS

| | | | | | |
|---|---|---|---|---|---|
| 1,644,742 | A | * | 10/1927 | Moynihan | 40/576 |
| 2,515,664 | A | * | 7/1950 | Padgett | 40/576 |
| 3,905,139 | A | | 9/1975 | Cooper | 40/64 R |
| 3,943,646 | A | * | 3/1976 | Branham | 40/605 |
| 4,292,752 | A | | 10/1981 | Clark | 40/576 |
| 4,461,107 | A | * | 7/1984 | Grate | 40/576 |
| 4,475,300 | A | * | 10/1984 | Ledenican | 40/600 |
| 4,521,984 | A | * | 6/1985 | Murray | 40/576 |
| 4,682,430 | A | | 7/1987 | Ramsay | 40/576 |
| 4,817,316 | A | | 4/1989 | Walker | 40/576 |
| 4,977,698 | A | | 12/1990 | Seggerson | 40/576 |
| 4,991,334 | A | | 2/1991 | Amundsen | 40/568 |
| 5,088,221 | A | | 2/1992 | Bussiere et al. | 40/576 |
| 5,457,615 | A | | 10/1995 | Nezer | 362/223 |
| 5,588,238 | A | | 12/1996 | Visocky et al. | 40/618 |
| 5,636,463 | A | * | 6/1997 | Sharon et al. | 40/618 |
| 5,901,486 | A | | 5/1999 | Sharon et al. | 40/618 |
| 5,930,926 | A | * | 8/1999 | Kaplan | 40/611.08 |
| 6,282,825 | B1 | | 9/2001 | Godfrey et al. | 40/611 |
| 6,298,589 | B1 | | 10/2001 | Hillstrom | 40/574 |
| 6,401,373 | B1 | * | 6/2002 | Sexton | 40/576 |
| 2001/0032404 | A1 | | 10/2001 | Hillstrom | |

OTHER PUBLICATIONS

Spandex Company, "Slatz" full specifications, 2004, www.spandex.co.uk.
Spandex Company, "SlimSlatz" full specifications, 2004, www.spandex.co.uk.
Spandex Company, "Infopanel/Monoframe" full specifications, 2004, www.spandex.co.uk.

* cited by examiner

*Primary Examiner*—Gary C. Hoge
(74) *Attorney, Agent, or Firm*—Kremblas, Foster, Phillips & Pollick

(57) ABSTRACT

A menu system comprises a frame that receives interchangeable menu sections with different heights such that sections of various heights are combined to fill the frame space. The menu sections have a central web with upper and lower front channels that receive a presentation strip. Clips, catches, latches, and magnets are used to secure the menu sections in the frame. A preferred menu section uses upper and lower middle web portions attached to web ends. An end cap at the end of a menu section prevents inadvertent loss of presentation strips from the menu section. The end cap can be formed from resilient matter and latched to a web end.

20 Claims, 7 Drawing Sheets

MENU SYSTEM

CROSS REFERENCE TO RELATED APPLICATION

This is a continuation-in-part of my prior application Ser. No. 10/158,698, filed May 30, 2002 and issued as U.S. Pat. No. 6,688,025 on Feb. 10, 2004 which claims the benefit of U.S. Provisional Application 60/295,076 filed on May 31, 2001, all of which are both incorporated here by reference as if completely written herein.

BACKGROUND OF THE INVENTION

1. Field of the Invention

This invention pertains to menu systems that typically convey item availability and pricing schedules such as those often used in fast-food establishments. More specifically this invention relates to a menu system that provides a frame with an interchangeable set of menu sections of various heights that utilize various securing systems for quickly fastening the menu sections to the frame.

2. Background of the Invention

In one of its most basic forms, a menu consists of a single piece of sheet material on which items and prices are indicated. Some of the most simple menu systems consist of a chalk board or piece of poster board on which available items and their prices are handwritten on the board, e.g., hamburgers $1.95, fries, $0.99, and so forth. Although such sign systems are often associated with restaurant type displays, it is to be realized that such sign systems are used in a wide variety of industries and although the present invention is illustrated with restaurant-type sign systems, it is to be realized that the present invention is not limited to the restaurant industry.

With the advent of fast-food chains the graphics quality and display have improved considerably. Currently such establishments have back lit sign systems with a menu face of professionally created graphics and some flexibility as to specific items offered and price. Typically the menu face is a rigid sheet of clear plastic on which "permanent" graphics such as the establishment name and logo are permanently configured. "H tracks" are then permanently affixed to the menu face at a predetermined spacing to accept copy strips, backup strips, and price carriers inserted into opposing H-track channels mounted on the menu face with adhesive. In such an arrangement, the graphics and H tracks are a permanent feature of the plastic menu face. Only the copy and backup strips and the digits in the price carriers can be changed. In menu board designs, the H-tracks are applied in a semi-permanent fashion which allows their removal and re-application. However this tends to be a slow and tedious process and subjects the plastic menu face to marring and disfiguration if the adhesive is not completely removed.

Current menu systems tend to be expensive in that they require a complete new menu face whenever new graphics, logos, or messages are desired. For example, when it is desirable to feature a new item on a menu with prominent graphics, a complete transparent menu sheet (menu face) must be prepared with all new graphics, lettering, and H-strip layout. Similarly, all new menu faces must be prepared whenever an establishment wishes to feature a summer menu, a holiday menu, menus for other specialty and seasonal items. Needless to say, major menu changes can be quite costly, especially for regional and national chains which may be required to replace thousands of menus on a seasonal and holiday basis.

To meet the problems and shortcomings of the present menu systems, it is an object of the present invention to produce a menu system of high flexibility.

It is another object of the present invention to provide a menu system of completely interchangeable menu sections.

It is another object of the present invention to provide a menu that has menu sections of interchangeable height.

It is an object of the present invention to provide a menu face that allows for placement of menu line items in any position on the menu system.

It is an object of the present invention to reduce the amount of disassembly of menu board parts in changing the menu design.

Yet another object of the present invention is to provide a clip that holds each section of the menu firmly in place within the frame.

A further object of the present invention is to provide a retainer that holds all sections of the menu face firmly in position within the menu frame.

It is another object of the present invention to provide a menu section design that prevents light from coming through the space between menu sections.

It is a further object of the present invention to provide menu section components that are easy to assembly into the menu section.

It is an object of the present invention to utilized magnetic fasteners for quick interchange of menu sections.

The foregoing and other objects, features and advantages of the invention will become apparent from the following disclosure in which one or more preferred embodiments of the invention are described in detail and illustrated in the accompanying drawings. It is contemplated that variations in procedures, structural features and arrangement of parts may appear to a person skilled in the art without departing from the scope of or sacrificing any of the advantages of the invention.

SUMMARY

Referring to FIGS. 1 and 2, the menu system 50 of the present invention comprises:

a) a frame 54 comprising a top 132, a bottom 133, and opposite parallel sides 130, 131 that define a frame space 55;

b) interchangeable menu sections 74, 76, 78 of one or more heights and a width such that said menu sections 74, 76, 78 fill said frame space 55; and c) each of said interchangeable menu sections 74, 76, 78 comprising:

1) a web 95 with a center web portion 98, an upper web portion 99, and a lower web portion 97,
2) a lower front flange 81 projecting forward from said lower web portion 97 at essentially a right angle;
3) an upper front flange 91 projecting forward from said upper web portion 99 at essentially a right angle;
4) a lower front lip 84 projecting upward from said lower front flange 81 to form a lower front channel 90; and
5) an upper front lip 86 projecting downward from said upper front flange 91 to form an upper front channel 88.

The center web portion 98 has an opening 106 formed in it for the illumination of presentation strips such as a backer strip 256 and a copy strip 258. As seen in FIG. 6, a light-blocking portion 96 extends back and upward from the upper web portion 99.

Referring again to FIG. 2, the menu section 78 can further comprise:

a) a lower rear flange 83 projecting backward from said lower web portion 97 at essentially a right angle;

b) an upper rear flange 93 projecting backward from said upper web portion 99 at essentially a right angle;

c) a lower rear lip 92 projecting upward from said lower rear flange 83 to form a lower rear channel 102; and d) an upper rear lip 94 projecting downward from said upper rear flange 93 to form an upper rear channel 108. As with the menu section embodiment shown in FIG. 6, the embodiment shown in FIG. 2 can also optionally comprise a light-blocking portion 96; however, in FIG. 2, the light-blocking portion 96 extends upward from the rearward end of said upper rear flange 93.

As seen in FIGS. 2–4, the interchangeable menu section 78 is secured in frame 130 by means of the clip 120 shown in FIG. 3 which, as seen in FIG. 2, is moveably received in the lower rear channel 102 and the upper rear channel 108. As seen in FIG. 4, the clip 120 comprises a catch 125 for immovably securing the clip 120 to the menu section 78. The clip 120 also comprises a clasp 110 for securing the clip 120 to the frame 130.

In addition to the clip 120, the present invention features other securing means for securing the interchangeable menu section in the frame. As seen in FIG. 4, the interchangeable menu section 78 is secured to frame 130 by a retainer 160 rotatably attached to the side of frame 130. The retainer 160 is immovably secured to the frame by means of latch 171. In FIG. 8, the menu section 78" is secured to side frame 130" by a first fastener member 192 and a second fastener member 194 where the first fastener member 192 can be a magnet attracting strip and the second fastener member is a magnet. Or the first fastener member 192 can be a pile portion of a Velcro fastener and 194 can be the hook portion of the Velcro fastener.

Referring to FIGS. 14–16, a second menu section embodiment is shown in which the web comprises:

1) a first web end 300 comprising a first end center web portion 302, a first end upper web portion 304, and a first end lower web portion 306;

2) a second web end 320 comprising a second end center web portion 322, a second end upper web portion 324, and a second end lower web portion 326;

3) a middle upper web portion 330 joined to said first end upper web portion 304 and to said second end upper web portion 324;

4) a middle lower web portion 340 joined to said first end lower web portion 306 and to said second end lower web portion 326; and 5) a center opening 375 formed by said first web end 300, said second web end 320, said middle upper web portion 330, and said middle lower web portion 340. The middle upper web portion 330 is joined to the first end upper web portion 304 and to the second end upper web portion 324 and the middle lower web portion 340 is joined to the first end lower web portion 306 and to the second end lower web portion 326 by means of post and hole assemblies 360. As seen in FIG. 17, an optional light-blocking portion 350 extends rearward and upward from the middle upper web portion 330.

FIG. 18 illustrates a latching endcap 400 that is attached at the rear edge of web end 300, 320 and with latch 406 latching over the front edge 305 of web end 300, 320.

Figure 1:
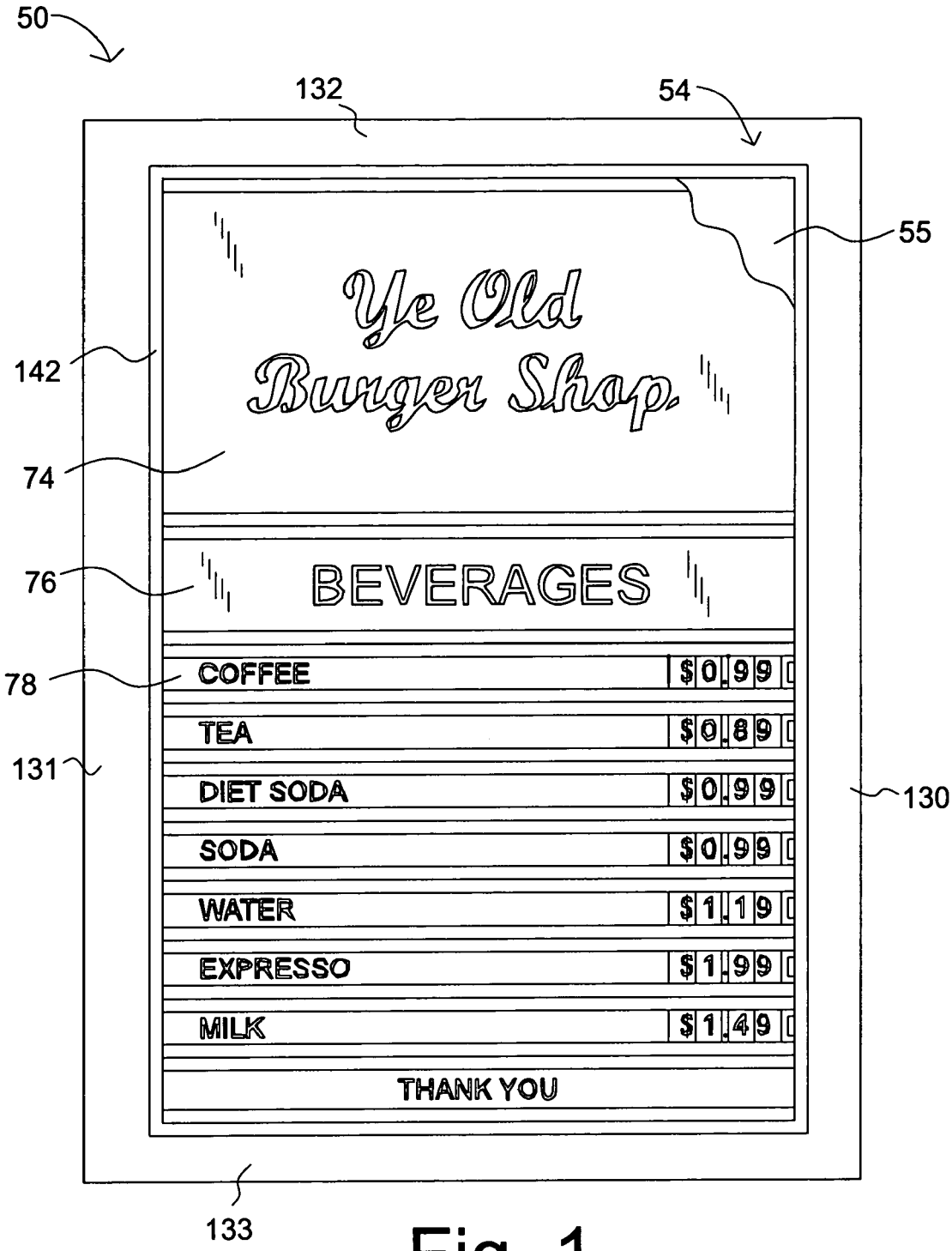
FIG. 1 is a front view that illustrates the frame and separate interchangeable menu sections of the current invention.

In describing the preferred embodiment of the invention which is illustrated in the drawings, specific terminology is resorted to for the sake of clarity. However, it is not intended that the invention be limited to the specific terms so selected and it is to be understood that each specific term includes all technical equivalents that operate in a similar manner to accomplish a similar purpose.

Although a preferred embodiment of the invention has been herein described, it is understood that various changes and modifications in the illustrated and described structure can be affected without departure from the basic principles that underlie the invention. Changes and modifications of this type are therefore deemed to be circumscribed by the spirit and scope of the invention, except as the same may be necessarily modified by the appended claims or reasonable equivalents thereof.

DETAILED DESCRIPTION OF THE INVENTION AND BEST MODE FOR CARRYING OUT THE PREFERRED EMBODIMENT

With reference to the drawings and initially FIG. 1, a menu system 50 is shown that comprises a mitered frame 54 having a top 132, a bottom 133, and opposite sides 130, 131 that defines a frame space 55. Individual, interchangeable menu sections 74, 76, and 78 of variable heights and a fixed width fill the frame space 55. As shown, interchangeable menu section 74 is a tall menu section, menu section 76 is of intermediate height, and menu section 78 is a short menu section. Preferably the menu sections are in heights that are multiple units of each other. Thus if section 78 is 1 unit wide, then section 76 is 2 units wide and section 74 is 6 units wide. Because each of the units are separate and interchangeable, a wide variety of signs can be created with the menu system 50 of the present invention. For example, if the total space 55 is 16 units high, one could form a sign with two tall units 74 (a total of 12 units) and four short units 78 (total of 4 units) to fill the available space 55. Another arrangement might have two tall units 74, an intermediate height unit 76, and two short units 78. As becomes apparent a wide variety of arrangements can be created using menu sections of various heights placed in various vertical positions within the total frame space 55.

Figure 2:
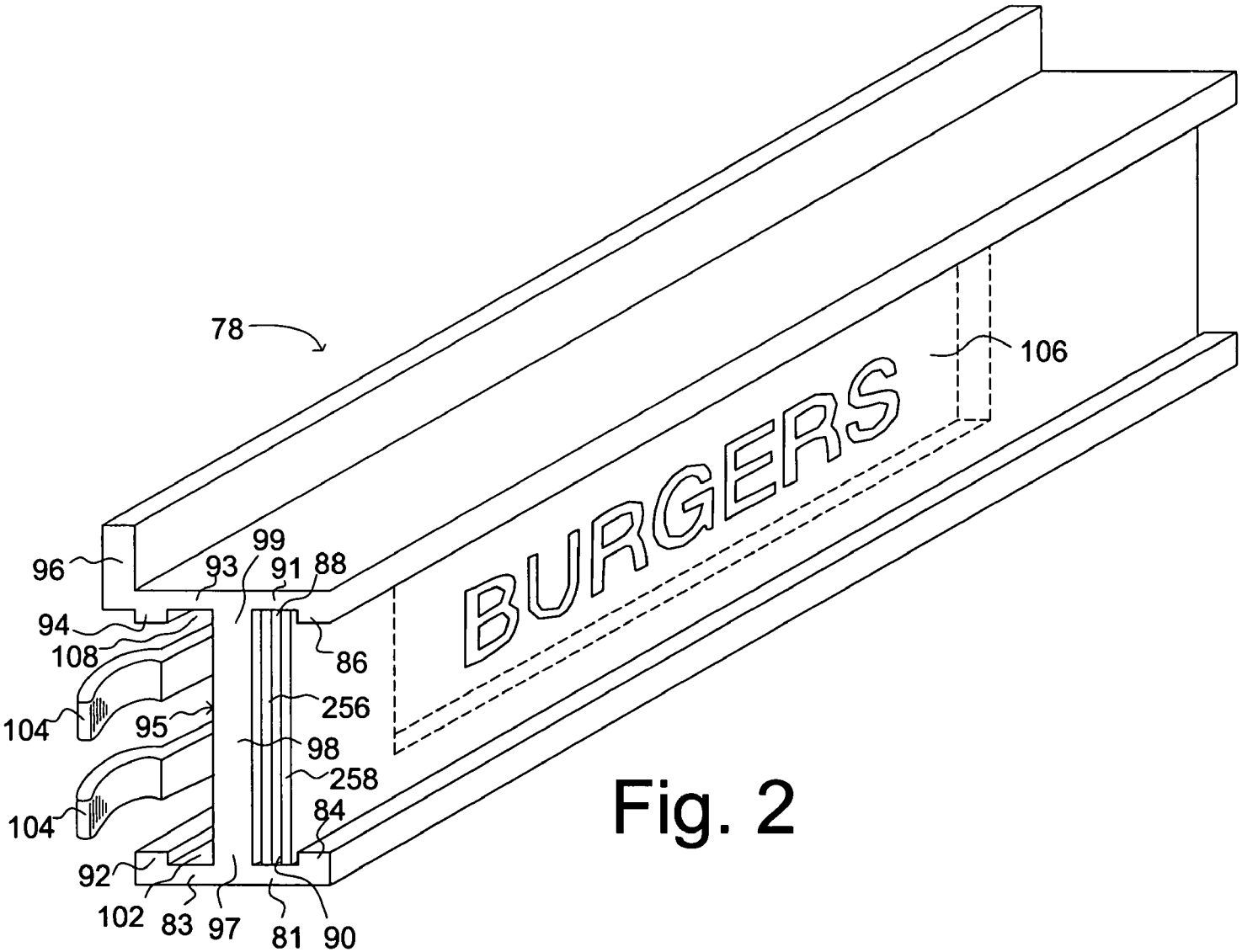
FIG. 2 is a perspective view of an interchangeable menu section of the current invention.

FIG. 2 illustrates a narrow menu unit 78 although it is to be realized that typically the only difference between the various menu units 74, 76, and 78 is the height of the unit. Menu unit 78 is an I-beam type configuration having a web 95 with a center web portion 98, an upper web portion 99 and a lower web portion 97. A lower front flange projects forward from the lower web portion 97 at essentially a right angle to web 95. An upper front flange 91 projects forward from the upper web portion 99 at essentially a right angle to web 95. A lower front lip 84 projects upward parallel to web 95. Lower front lip 84 along with lower front flange 81 and lower web portion 97 define a lower front channel 90. Similarly an upper front lip 86 projects downward parallel to web 95 and, along with upper front flange 91 and upper web portion 99 define an upper front channel 88. Upper front channel 88 and lower front channel 90 are sufficiently spaced apart and of a width to accept one or more presentation strips including backing strips 256, copy strips 258, and digit carriers currently used in conventional menu systems. Optionally, an opening 106 formed in the center web portion allows for backlighting of the backing and copy strips 256 and 258.

Figure 6:
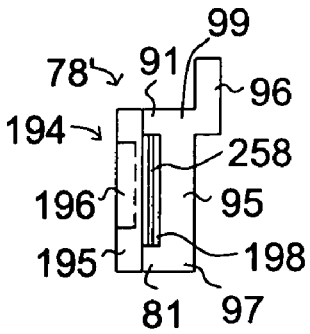
FIG. 6 is an end view of the menu section of FIG. 5 in which the ends of the upper and lower front lips are replaced with an end spacer bridges the upper and lower front flanges and retains a recessed magnet.
Figure 11:
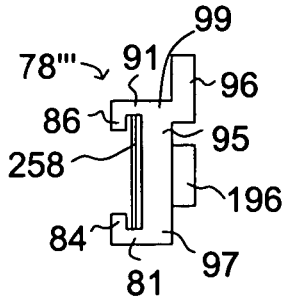
FIG. 11 is an end view of a menu section in which the rear channels have been eliminated and a magnet is fastened to the center web portion.

When backlighting is used or the rear of the menu system 50 is unprotected from strong ambient light, this light often bleeds through any spaces that might exist between individual menus sections 74, 76, and 78. To eliminate light bleed through, a light-blocking projection can be used to cover possible spaces that might exist between the individual menu sections. As seen in FIGS. 6 and 11, light-blocking projection 96 extends rearward and upward from the upper web portion 99. When in position, light-blocking projection 96 lies entirely behind lower web portion 97. Light-block projection extends sufficiently rearward such that the base of the next higher menu section rests entirely on the top of the lower menu section such as seen in FIG. 12*b*, it being realized that the menu section in FIG. 12*b* is different from FIGS. 6 and 11 but the light blocking projection alignment and contact of contiguous bottom to top menu sections is the same. It is also to be realized that although the light-blocking projection 96 may also extend downward, that is, the menu sections may be rotated 180 degrees about their longitudinal axis with the same light blocking effect.

Figure 3:
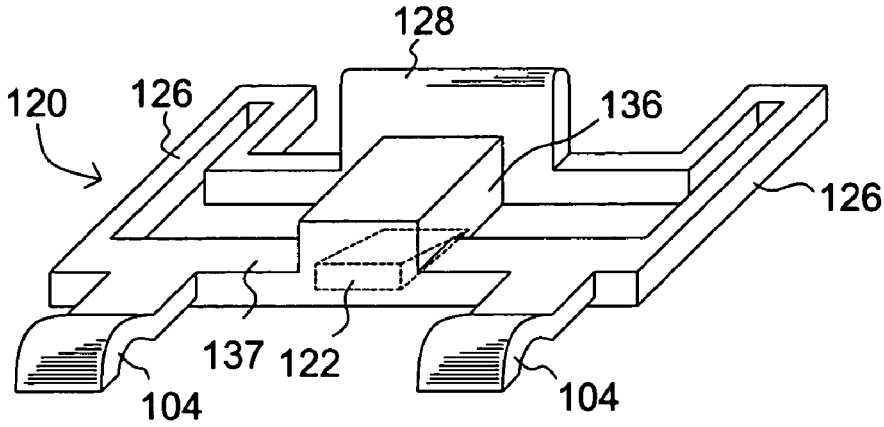
FIG. 3 is a perspective view of a clip according to the present invention for securing interchangeable menu sections to the side frame members.
Figure 4:
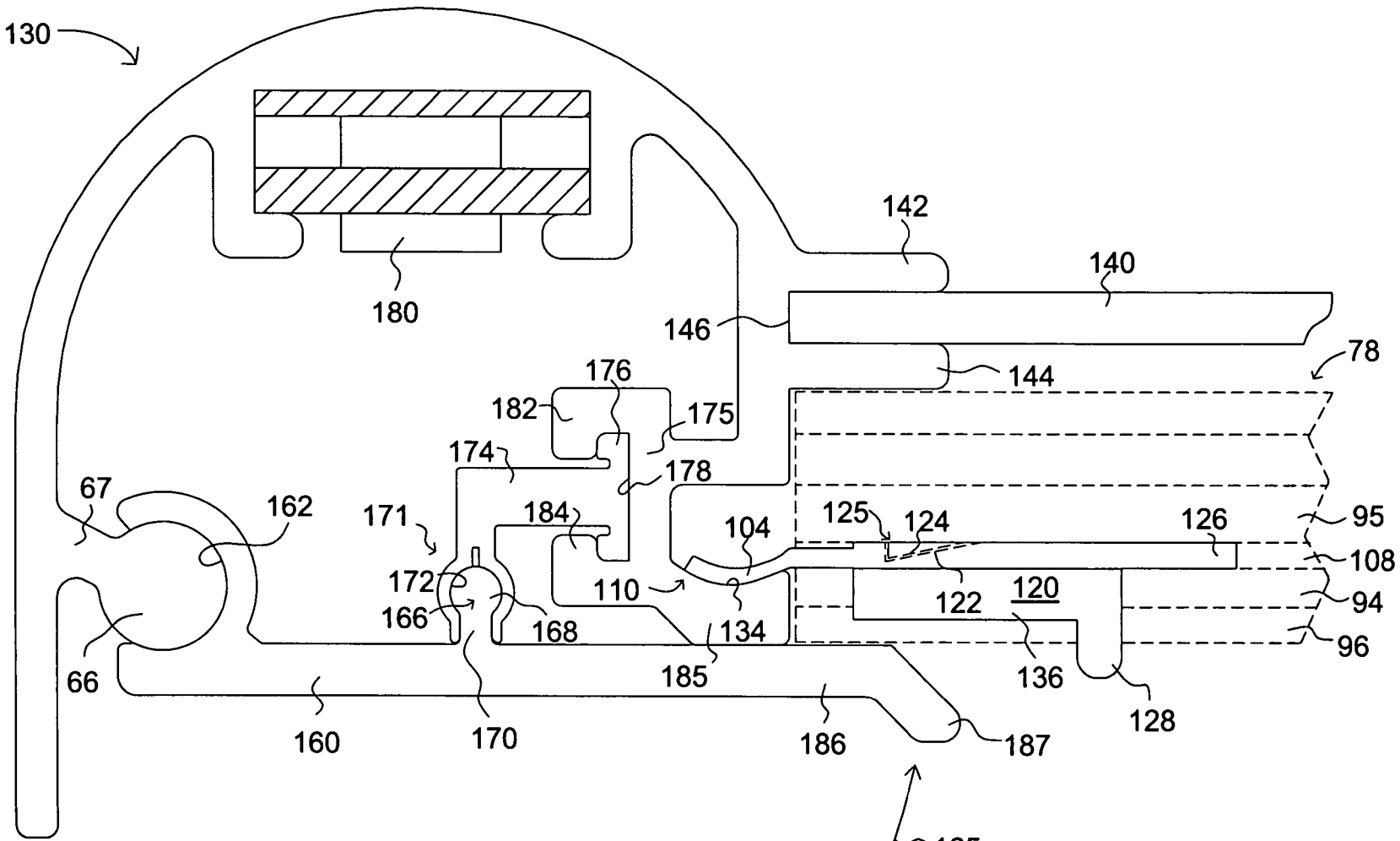
FIG. 4 is a top view of a side frame member that illustrates the use of a clip to secure individual menu sections to the side frame members including a notch and projection for locking the clip to the menu section and a clasp for retaining all of the menu sections within the menu frame.

In one method of securing the interchangeable menu sections 74, 76, and 78 to said frame, a second set of rearward channels are used to retain a slidable clip 120 illustrated in FIGS. 2–4. Referring initially to FIG. 2, a lower rear flange 83 projects backward from said lower web portion 97 at essentially a right angle and a lower rear lip 92 projects upward from the lower rear flange 83 parallel to web 95. The lower backside of lower web portion 97, the lower rear flange 83, and the upper projecting lower rear lip form a lower rear channel 102. Similarly, an upper rear flange 93 projects backward from said upper web portion 99 at essentially a right angle and an upper rear lip 94 projects downward from the upper rear flange 93 parallel to web 95. The upper backside of upper web portion 99, the upper rear flange 93, and the downward projecting upper rear lip form an upper rear channel 108.

As seen in FIG. 3, clip 120 has a central block portion 136 and a front section 137 from which two fingers 104 project. Legs 126 are attached to front section 137 and ride in spaced-apart lower and upper rear channels 102 and 108, respectively, of the menu sections 74, 76, and 78 as shown in FIG. 1. Returning to FIG. 3, a handle projection 128 is used to move the clip 120 in the lower and upper rear channels 102 and 108 and lock and unlock it from the side frame members 130, 131. As shown in FIG. 4, a clasp 110 is formed by the curved fingers 104 of clip 120 engaging a curved recess 134 in leg 185 of frame member 130. A catch 125 is comprised of a small ramp projection 124 (shown in phantom) on the rear side of central web portion 98 and a similar ramped shaped recess 122 in the central block 136 of clip 120. As the clip is moved toward frame side 130, the bottom of central block 136 rides up the ramp projection until it engages recess 122 in central bock 136. At this point, the end wall of the ramp and the end wall of the recess contact each other and firmly lock the clip 120 to menu section 78 and the engagement of curved finger 104 of clip 120 with the recess 134 in leg 184 firmly secures the menu section 78 to side frame member 130. It is to be realized that a similar clip 120, clasp 110 and catch 125 are used at the opposite end of menu section 78 to secure that end of the menu section to side frame member 131. Also it is to be realized that the securing devices are merely illustrative and that those skilled in the art will recognized that other securing devices will work equally well.

As with the menu section embodiment shown in FIGS. 6 and 11, the interchangeable menu section shown in FIG. 2 can also optionally comprise a light-blocking portion 96. However, in FIG. 2, the light-blocking portion 96 extends upward from the rearward end of said upper rear flange 93. The alignment of light-blocking portion 96 with contiguous menu sections is more fully shown in FIG. 12*b*. As can be seen, the top of upper portion between the upward projection 96 and the front edge of the top of the upper portion is the same width as the base of the bottom section and allows stacking of the menu sections 74, 76, and 78, one on top of another, within the menu frame 54.

FIG. 4 is a top view of the right frame member 130 as viewed in FIG. 1 with the top frame member 132 removed. Inward directed frame projections 142 and 144 form a channel 146 which secures a transparent cover sheet 140 that covers the face of the menu sections 74, 76 and 78. The menu frame 54 is "back-loaded" by placing the frame face down. Each menu section (74, 76, 78) is then placed in the frame 54 so as to come to rest on the back side of projection 144. In FIG. 4, menu section 78 is shown in phantom with the front edge in position against the rear of projection 144. Once the frame section is in place, clips 120 at each end of frame section 78 are slid outward in channels 102 and 108 until projecting fingers 104 engage the recesses 134 in leg 185 of the clasp fastener 110 in the right and left frame members, 130 and 131, respectfully. At the same time, clip 120 rides up over projection 124 on the rear of center web portion 98 of the menu section 78 until projection 124 engages recess 122 formed in the central portion 136 of clip 120 to lock clip 120 with respect to menu section 78 using catch 125.

As shown in FIG. 4, the present invention also features a menu strip retainer 160 that maintains all of the menu sections 74, 76, and/or 78 in place within the menu frame 54. The menu strip retainer 160 has a socket 162 formed at one end which engages the rod-shaped projection 66 at the end of post 67 which projects inward from the outer edge of frame member 130. Menu strip retainer 160 rotates about round rod-shaped projection 66 as shown by arrow 165. A latch 171 that comprises a rod and mounting post projection 166 and socket 172 mounted to frame 130. The rod and mounting post projection 166 comprises a terminal rod 168 mounted on oblong projection 170 which extends from the mid-portion of menu strip retainer 160. Rod 166 engages socket 172 which is at a right angle to the first end of central piece 174. The opposite end of central piece 174 is formed as a base member 176 whose ends firmly engage a slot 178 formed by fingers 182 and 184 that project outward from the interior side of frame member 130.

After all of the menu sections 74, 76, and 78 have been back-loaded into the menu frame 54 against projection 144 and the clips 120 locked in place with catch 125 and clasp 110, the menu strip retainer 160 is rotated about rod projection 66 until rod projection 166 engages and is held in place by socket 172, i.e., by latch 171. The end portion 186 of retainer 160 opposite the end with socket 162 engages the back side of upward projecting sections 96 (shown in phantom in FIG. 4) and holds all of the menu sections 74, 76, and 78 securely in place. Retainer end 187 is bent outward for ease in rotating retainer 160 to the open position. Corner clip 180 is conventional and holds the extruded frame members together at their mitered corners.

Figure 5:
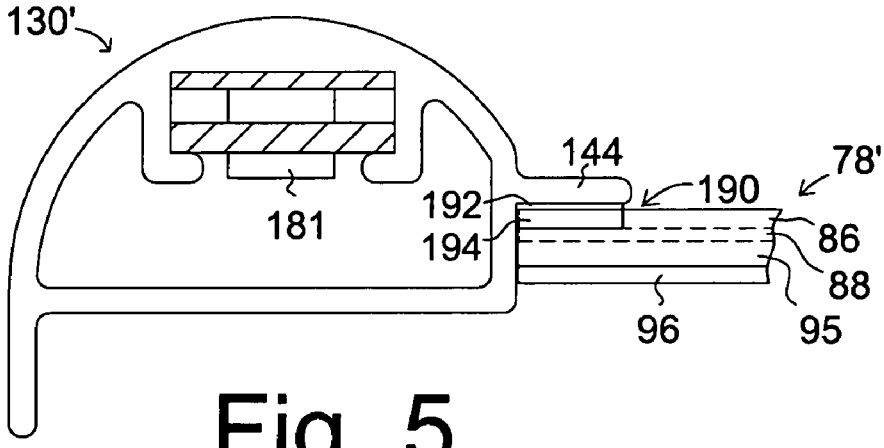
FIG. 5 is a top view of a second version of a side frame member and portion of a menu section in which the menu section is back loaded and held in place with a fastener having a first fastener member and a second fastener member such as a metal strip and magnetic or a hook and pile (Velcro) fastener.
Figure 7:
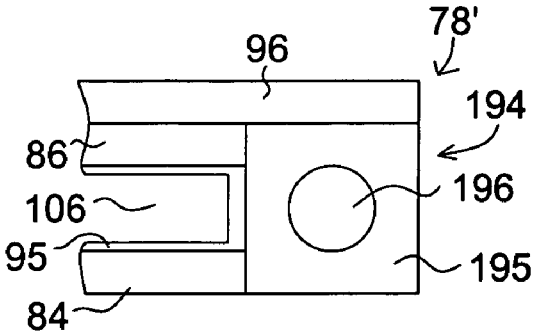
FIG. 7 is partial plan view of the menu section shown in FIGS. 5 and 6 further illustrating the end spacer bridge and recessed magnet.

FIGS. 5–7 illustrate the use of a fastener 190 with a first fastener member 192, e.g., a looped pile or a magnet attracting sheet, and a second fastener member 194, e.g., a hook or a magnet. Thus faster 190 could be a hook and pile fastener, e.g., Velcro, or a magnet and magnet attracting sheet. For a back-loaded system in which the menu sections 78' are loaded from the back against frame side projection 144, a strip of Velcro pile or steel strip 192 is attached to the back of frame member projection 144 and the Velcro hook or magnet 194 attached to an end bridging member 195. As seen, an end portion of the upper front lip 86 and an end portion of the lower front lip 84 of menu section 78' are removed and spacer 195 is attached to the upper front flange 91 and the lower front flange 81, typically by using a suitable adhesive. Velcro hooks may then be applied to the front of spacer 195 to engage Velcro pile 192 or a magnet 196 may be recessed into spacer 195 as shown in FIGS. 6 and 7.

Figure 8:
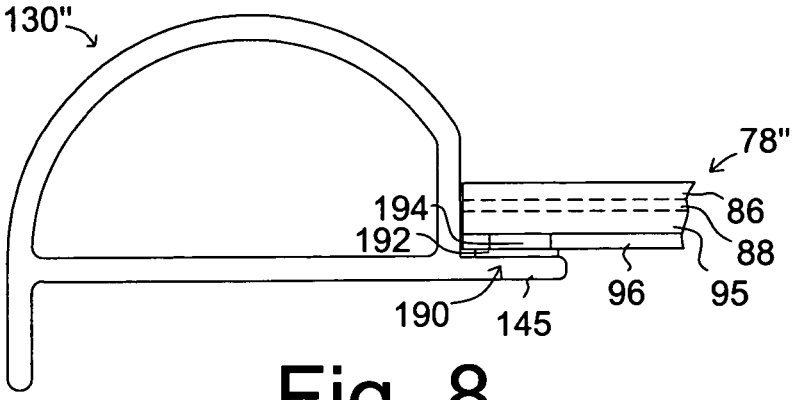
FIG. 8 is a top view of a third version of a side frame member and portion of a menu section in which the menu section is front loaded and held in place with a fastener having a first fastener member and a second fastener member such as a metal strip and magnet or a hook and pile (Velcro) fastener.
Figure 9:
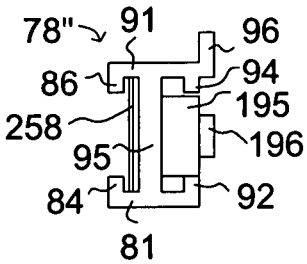
FIG. 9 is an end view of the menu section of FIG. 8 in which the rear channels of the menu section are converted from clip to magnetic use by using a spacer and a magnet.
Figure 10:
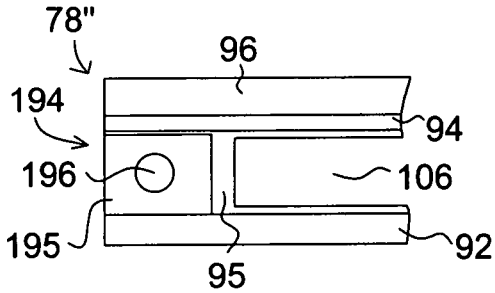
FIG. 10 is partial plan view of the menu section shown in FIGS. 8 and 9 further illustrating the clip replacement with a spacer and magnet.

FIGS. 8–10 show a front-loaded menu system in which the menu section 78 with rear upper and lower channels 102 and 108 as shown in FIG. 2 is converted to use with a magnetic fastener. In this instance, a space block 195 is cut to fit and essentially to fill the space between the bottom of the upper rear lip 94 and the top of the lower rear lip 92 and to fill the space between the rear surface of web 95 and the front edges of upper and lower rear lips 94 and 92, respectively. Spacer 195 is affixed to web 95 with an appropriate adhesive. A magnet 196 with a thickness equal to that of light-blocking portion 96 is attached to spacer 195 typically with an appropriate adhesive. More generally, the thickness of the spacer 195, the magnet 196 and adhesive should position the back edge of magnet 196 in a plane with the back edge of light-blocking portion 96. As shown in FIG. 8, a magnet attracting strip 192 is attached to the front of side frame projection 145, typically with a suitable adhesive as, for example, a double sided adhesive tape.

Figure 12A:
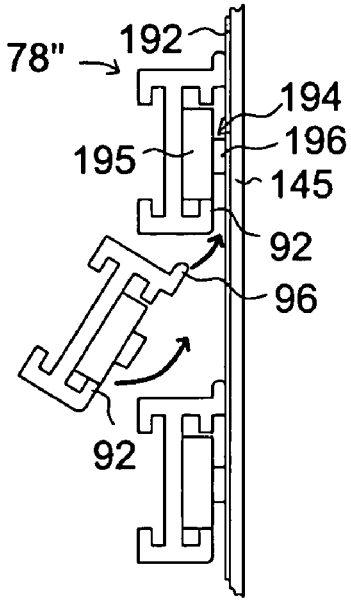
FIG. 12*a* is an end view illustrating the front loading of a magnetic menu section into a frame.
Figure 12B:
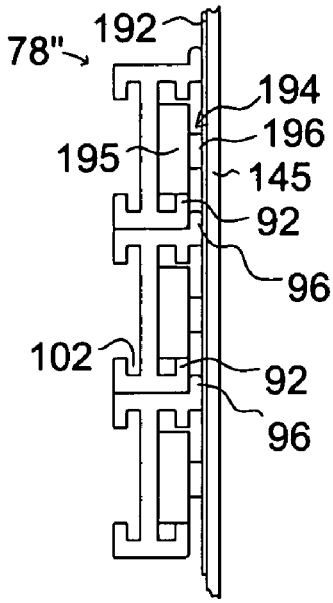
FIG. 12*b* is an end view illustrating a set of three menu sections after the loading process shown in FIG. 12*a*.

FIGS. 12*a* and 12*b* show generally the process involved in inserting and removing interchangeable menu sections 78" having magnetic fasteners 196. To insert a menu section 78, the bottom of the menu section is rotated outward so that the light-blocking portion 96 can be inserted behind the lower rear lip 92. Once the light-blocking portion is started, the menu section is rotated to bring the bottom into the remaining vacant space and bring magnet 196 in contact with magnetic attracting strip 192 attached to side frame projection 145. Unlike Velcro which does not allow motion with respect to the two surfaces, the magnet allows the menu section 78" to be slid with respect to the metal surface 192 and fine adjustments made in the position of the menu section 78" with respect to the menu frame 54. FIG. 12*b* illustrates the menu sections 78" when affixed to the frame projection 145.

To remove the menu sections 78", the lower front lip is grasped in channel region 102 and the bottom rotated out of position against frame projection 145 until the bottom clears the upper surface of the next lower menu section at which time the menu section is pulled downward and out to remove light-blocking projection 96 from behind the next higher menu section.

FIG. 11 is an end view of a menu section 78''' showing a menu section without rearward upper and lower flanges 93 and 83 and upper and lower lips 94 and 92. Further, the light-blocking portion extends rearward and upward directly from the upper web portion 99. The thickness of the magnet should be such or else adjusted with a space so that the rear surface of magnet 196 is in the same plane as the rear surface of light-blocking portion 96.

Figure 13:
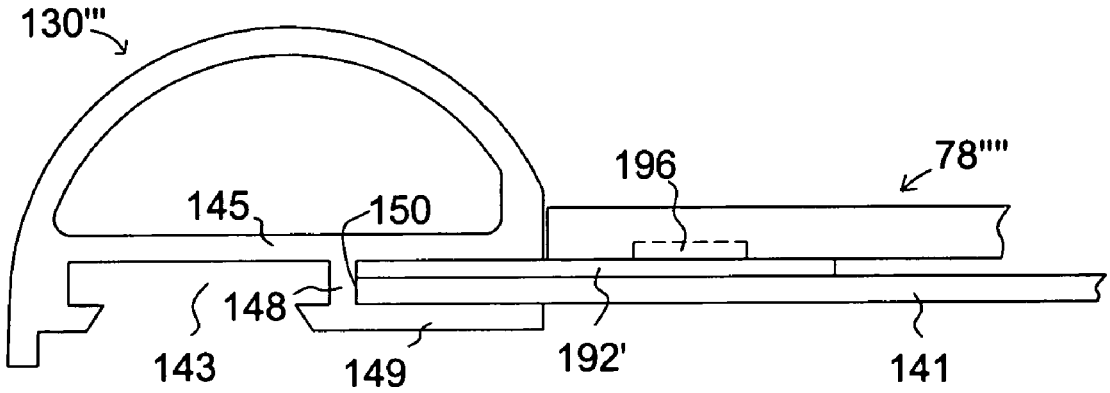
FIG. 13 is a top view of a side frame member in which a magnetic menu section is front loaded with the magnet adhering to a metal strip adhered to a backing sheet contained in a slot formed at the back of the frame member.

FIG. 13 illustrates a front-loaded menu system in which the menu sections have no light-blocking projection 96 or rearward upper and lower flanges 93, 83 or upper and lower rear lips 94, 92. As shown, light-blocking opaque sheet material 141 is mounted in side frame member slot 150 formed by the based of frame member 130''', downward extending projection 148, and inward projecting finger 149. A magnet attracting strip 192' is affixed to sheet material 141 and also insert into slot 150 along with sheet material 141. The magnet 196 is recessed directly into the vertical web 95 so that the outer surface of magnet 196 is flush with the rear surface of web 95. In this instance, the menu sections 78'''' may be inserted directly into the open space without having to rotate the menu section in order to engage the light-blocking portion 96 behind the rear of the next higher menu section. Of course, sheet material 141 is not limited to opaque material, translucent and transparent sheet material may be used as the arrangement will also accommodate menu sections with light-blocking projections 96 as have been previously described. Also it is to be realized that when higher menu sections are used such as menu sections 74 and 76, more than one magnet 196 may have to be used.

FIGS. 14–17 illustrate another embodiment of interchangeable menu section 78'''''. Here the center web portion of the web is formed by the first end center web portion 302 of first web end 300 and the second end center web portion 322 of second web end 320. The upper web portion of the web is formed from the first end upper web portion 304, a middle upper web portion 330, and a second end upper web portion 324. The lower web portion of the web is formed from the first end lower web portion 306, a middle lower web portion 340, and a second end lower web portion 326. The first and second end center web portions 302 and 322, respectively and middle upper web portion 330 and middle lower web portion 340 define opening 375 similar to opening 106 in center web 95 of the menu section 78 illustrated in FIG. 2.

The upper center web portion 330 is joined to the first end upper web portion 304 and the second end upper web portion 324 with a post and hole assemblies 360. Similarly the lower center web portion 340 is also joined to the first end lower web portion 306 and to the second end lower web portion with post and hole assemblies 360.

Figure 14:
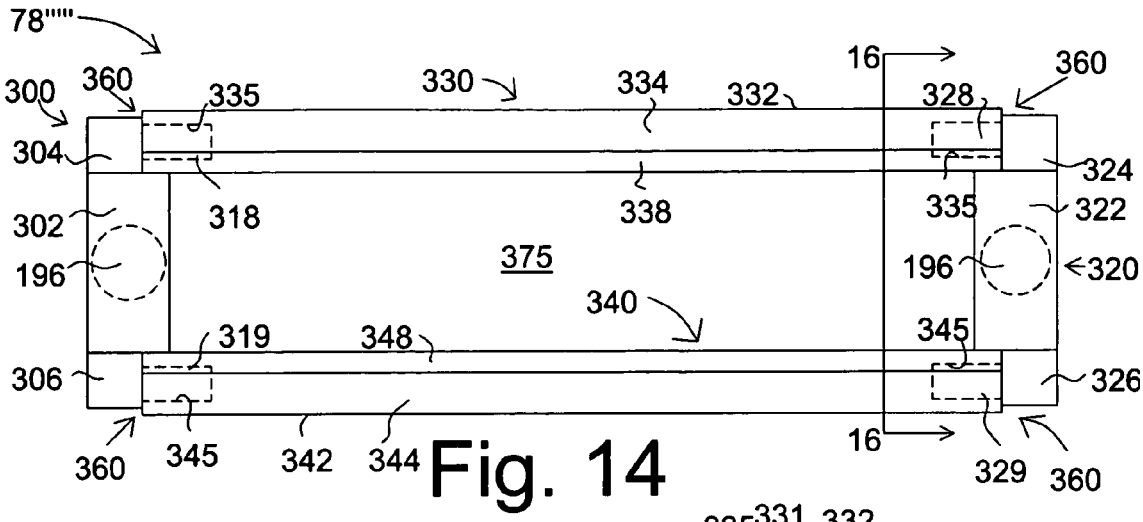
FIG. 14 is a front plan view of another embodiment of an interchangeable menu section in which the menu section is formed from two end pieces with upper, center, and lower web portions, and an upper and a lower middle web portion joined to the upper and lower web portions of the two end pieces.
Figure 16:
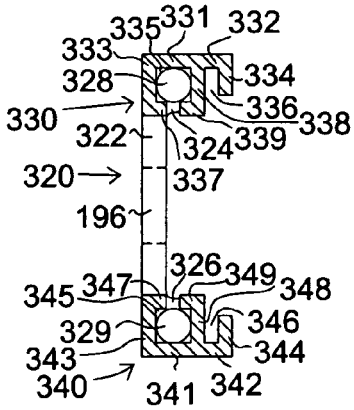
FIG. 16 is a cross-section view along 16—16 of FIG. 14 showing the engagement of the posts of the right end piece in the holes in the middle upper web portion and the middle lower web portion.

Using the upper right post and hole assembly of FIG. 14 as an example, second end upper web portion comprises a post 328 extending to the left of the page and inserted into a hole 335 in the middle upper web portion 330 as seen in FIG. 16. As seen in FIG. 16, hole 335 is formed by a top upper web member 331, two side upper web members 333 and 338, and two bottom upper web members 337 and 339 that extend toward each other from side members 333 and 338, respectively. Typically the middle upper web member 330 is a metal extrusion with hole 335 extending the length of middle upper web member 330. The opening between bottom upper web members 337 and 339 allows a bit of give when post 328 is force fit into hole 335.

An upper flange 332 extends forward from side upper web member 338 at right angles to it. An upper lip 334 extends downward from upper flange 332 with the upper lip 334, upper flange 332, and side upper web member 338 forming upper front channel 336.

Similarly a hole 345 is formed in middle lower web portion 340 by bottom lower web member 341, two side lower web members 343 and 348, and two top lower web members 347 and 349 that extend toward each other from side members 343 and 348, respectively. A lower flange 342 extends forward from side lower web member 348 at right angles to it. A lower lip 344 extends upward from lower flange 342 with the lower lip 344, the lower flange 342, and the side lower web member 348 forming lower front channel 346. As with the upper and lower front channels 88 and 90 of FIG. 2, upper and lower front channels 336 and 346 are spaced-apart sufficiently to accept presentation strips such as backer and copy strips. These have been omitted for the sake of clarity.

Figure 15:
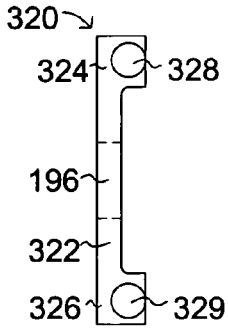
FIG. 15 is a left plan view of the right end piece illustrating the location of the posts that join the upper and lower web portions of the end piece to the middle upper web portion and the middle lower web portion.

Because the web construction shown in FIGS. 14–16 have no rearward projections, the back of the web engages directly the supporting structure of the frame. As such, magnets 196 are force fit into a hole in first and second end center web portions 302 and 322, respectively, or otherwise molded into the center web portions 302, 322. Because there is no light-blocking section, such menu sections are best used with opaque sheet material 141 as shown in FIG. 13.

Figure 17:
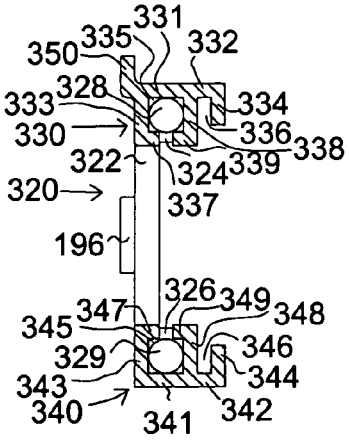
FIG. 17 is a cross-sectional view similar to FIG. 16 and further illustrating a light-blocking portion extending from the middle upper web portion.

FIG. 17 is an end view of a menu section similar to that illustrated in FIGS. 14–16 except that a light blocking projection 350 extends rearward and upward from side member 333 of upper web portion 330. Here magnets 196 are glued to the backs of the first and second end center web portions so that the rear of magnets 196 and the rear of light-blocking projection 350 lie in the same plane.

Figure 18:
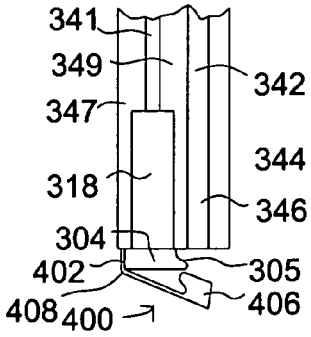
FIG. 18 is a partial top view of the left end of a menu section similar to that shown in FIGS. 14–16 with the middle upper web portion removed to show an end cap that prevents the presentation strips in the front channels from inadvertently slipping out during handling.

FIG. 18 is a top view of the first end portion of a menu section similar to those shown in FIGS. 14–16. The middle upper web portion 330 has been removed. The first web end 300 (visible in FIG. 18 as the first end web portion 304) has a resilient end cap 400 secured at one end to the rear edge of first web end 300. The front end of first web end 300 is shaped as catch 305. Latch 406 rotates about cloth-type hinge 408 and is latched over catch 305. In the latched position latch 406 blocks the length of the opening formed by upper channel 336 and lower channel 346 and prevents the presentations strips (backing and copy strips and digit carriers) from inadvertently falling out of the channels. The end cap 400 is used on both ends of the menu section.

It is possible that changes in configurations to other than those shown could be used but that which is shown is preferred and typical. Without departing from the spirit of this invention, various means of fastening the components together may be used.

It is therefore understood that although the present invention has been specifically disclosed with the preferred embodiment and examples, modifications to the design concerning sizing and shape and methods and devices for latching and securing will be apparent to those skilled in the art and such modifications and variations are considered to be equivalent to and within the scope of the disclosed invention and the appended claims.

It is possible that changes in configurations to other than those shown could be used but that which is shown is preferred and typical. Without departing from the spirit of this invention, various means of fastening the components together may be used.

What is claimed is:

1. A menu system comprising:

a) a frame comprising a top, a bottom, and opposite parallel sides that define a frame space;

b) interchangeable menu sections of one or more heights and a width such that said menu sections fill said frame space; and c) each of said interchangeable menu sections comprising:

1) a web with a center web portion, an upper web portion, and a lower web portion, 2) a lower front flange projecting forward from said lower web portion at essentially a right angle;
3) an upper front flange projecting forward from said upper web portion at essentially a right angle;
4) a lower front lip projecting upward from said lower front flange to form a lower front channel;
5) an upper front lip projecting downward from said upper front flange to form an upper front channel;
6) a first web end comprising a first end center web portion, a first end upper web portion, and a first end lower web portion;
7) a second web end comprising a second end center web portion, a second end upper web portion, and a second end lower web portion;
8) a middle upper web portion joined to said first end upper web portion and to said second end upper web portion;
9) a middle lower web portion joined to said first end lower web portion and to said second end lower web portion;
10) a center opening formed by said first web end, said second web end, said middle upper web portion, and said middle lower web portion; and
11) wherein said middle upper web portion is joined to said first end upper web portion and to said second end upper web portion and said middle lower web portion is joined to said first end lower web portion and to said second end lower web portion by means of post and hole assemblies.

2. The menu system according to claim 1 wherein said lower front channel and said upper front channel are sufficiently spaced-apart to receive at least one presentation strip.

3. The menu system according to claim 2 further comprising an end cap.

4. The menu system according to claim 1 with said center portion of said web having an opening formed therein.

5. The menu system according to claim 1 further comprising:
a) a lower rear flange projecting backward from said lower web portion at essentially a right angle;
b) an upper rear flange projecting backward from said upper web portion at essentially a right angle;
c) a lower rear lip projecting upward from said lower rear flange to form a lower rear channel; and
d) an upper rear lip projecting downward from said upper rear flange to form an upper rear channel.

6. The menu system according to claim 5 further comprising a light-blocking portion extending upward from the rearward end of said upper rear flange.

7. The menu system according to claim 5 wherein said interchangeable menu section is secured in said frame by a clip moveably received in said lower rear channel and said upper rear channel.

8. The menu system according to claim 7 with said clip comprising a catch for immovably securing said clip to said interchangeable menu section.

9. The menu system according to claim 7 with said clip comprising a clasp for securing said clip to said frame.

10. The menu system according to claim 1 further comprising securing means for securing said interchangeable menu section in said frame.

11. The menu system according to claim 1 wherein said interchangeable menu section is secured to said frame by a retainer rotatably attached to said side of said frame.

12. The menu system according to claim 11 wherein said retainer is immovably secured to said frame by means of a latch.

13. The menu system according to claim 1 wherein said interchangeable menu section is secured to said frame by a magnetic fastener.

14. The menu system according to claim 1 wherein said interchangeable menu section is secured to said frame by a hook and pile fastener.

15. The menu system according to claim 1 further comprising a light-blocking portion extending rearward and upward from said middle upper web portion.

16. A menu section comprising:
1) a first web end comprising a first end center web portion, a first end upper web portion, and a first end lower web portion;
2) a second web end comprising a second end center web portion, a second end upper web portion, and a second end lower web portion;
3) a middle upper web portion joined to said first end upper web portion and to said second end upper web portion;
4) a middle lower web portion joined to said first end lower web portion and to said second end lower web portion;
5) a center opening formed by said first web end, said second web end, said middle upper web portion, and said middle lower web portion;
6) a lower front flange projecting forward from said middle lower web portion at essentially a right angle;
7) an upper front flange projecting forward from said middle upper web portion at essentially a right angle;
8) a lower front lip projecting upward from said lower front flange to form a lower front channel; and
9) an upper front lip projecting downward from said upper front flange to form an upper front channel; and
10) wherein said middle upper web portion is joined to said first end upper web portion and to said second end upper web portion and said middle lower web portion is joined to said first end lower web portion and to said second end lower web portion by means of post and hole assemblies.

17. The menu section according to claim 16 further comprising a light-blocking portion extending rearward and upward from said middle upper web portion.

18. The menu section according to claim 16 further comprising a magnet.

19. The menu section according to claim 16 further comprising an end cap.

20. The menu section according to claim 19 wherein a front end of said first web end is shaped as a catch and said end cap is a resilient end cap secured at one end to a rear edge to said first web end and having a latch to latch to said catch and prevent a presentation strip from falling from an opening formed by said lower front channel and said upper front channel.

* * * * *